US006425748B1

(12) United States Patent
Miller

(10) Patent No.: US 6,425,748 B1
(45) Date of Patent: Jul. 30, 2002

(54) POSITIVE DISPLACEMENT ROTARY PUMP

(75) Inventor: John P. Miller, Northville, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 09/821,989

(22) Filed: Apr. 2, 2001

(51) Int. Cl.[7] ..... F04C 15/00

(52) U.S. Cl. ..... 418/180; 418/15; 418/77; 418/79; 418/171; 418/259

(58) Field of Search ..... 418/180, 171, 418/77, 79, 15

(56) References Cited

U.S. PATENT DOCUMENTS

| | | | | | |
|---|---|---|---|---|---|
| 3,242,867 | A | * | 3/1966 | Mosbacher | 418/171 |
| 5,711,660 | A | * | 1/1998 | Mitarai et al. | 418/171 |
| 5,716,201 | A | * | 2/1998 | Peck et al. | 418/180 |

FOREIGN PATENT DOCUMENTS

| | | | | |
|---|---|---|---|---|
| DE | 3614626 | * | 12/1986 | 418/79 |
| JP | 63-131878 | * | 6/1988 | 418/180 |
| JP | 05-164060 | * | 6/1993 | 418/171 |

* cited by examiner

*Primary Examiner*—Thomas Denion
*Assistant Examiner*—Theresa Trieu
(74) *Attorney, Agent, or Firm*—Leslie C. Hodges

(57) ABSTRACT

A positive displacement rotary pump including a housing having an internal chamber and inlet and discharge ports, a sealing land on the housing between a downstream end of the inlet port and an upstream end of the discharge port, and a rotating group in the internal chamber defining a plurality of pump chambers. The pump chambers traverse in succession and at regular intervals the inlet port and the sealing land and the discharge port. The housing has a stationary pre-charging passage which communicates with the discharge port and overlaps the sealing land. The rotating group includes a plurality of rotating pre-charging passages which communicate with respective ones of the pump chambers. As each rotating pre-charging passage attains overlap with the stationary pre-charging passage, the low pressure of the fluid trapped in the corresponding pump chamber sealed closed in the sealing land increases rapidly and induces a pulse in the fluid in the discharge port and in the fluid system connected to the discharge port. The angular separation between the rotating pre-charging passages is randomly unequal so that the intervals between pulses are irregular. The irregular intervals between the pulses suppresses tonal pump noise.

8 Claims, 2 Drawing Sheets

POSITIVE DISPLACEMENT ROTARY PUMP

TECHNICAL FIELD

This invention relates to positive displacement rotary pumps.

BACKGROUND OF THE INVENTION

A positive displacement rotary pump typically includes a housing, an internal chamber in the housing, inlet and discharge ports in the housing intersecting the internal chamber, and a rotating group in the internal chamber defining a plurality of variable volume pump chambers which sweep in succession across and transfer fluid from the inlet port to the discharge port. The pump chambers traverse a sealing land on the housing between a downstream end of the inlet port and an upstream end of the discharge port and are sealed closed in the sealing land to prevent backflow from the discharge port to the inlet port. The pressure of the fluid trapped in the pump chambers in the sealing land is usually considerably below the high fluid pressure prevailing at the discharge port. Therefore, as succeeding ones of the pump chambers attain overlap with the upstream end of the discharge port, the fluid pressure therein increases rapidly to the high fluid pressure prevailing in the discharge port. The resulting regular pulses in the fluid in the discharge port and in the fluid system connected thereto constitute a potential source of pump noise having tonal character, i.e. noise that is concentrated at a discrete frequency and possibly whole number multiples of that frequency called harmonics. In positive displacement rotary vane pumps, it is known to suppress such noise by varying the angular separation between at least some of the vanes to alter the frequency content of the pulses. This approach is not universally applicable to all positive displacement rotary pumps, e.g. gerotor pumps and gear pumps. Consequently, manufacturers continue to seek improved positive displacement rotary pumps.

SUMMARY OF THE INVENTION

This invention is a new and improved positive displacement rotary pump including a housing having an internal chamber and inlet and discharge ports intersecting the internal chamber, a sealing land on the housing between a downstream end of the inlet port and an upstream end of the discharge port, and a rotating group in the internal chamber defining a plurality of pump chambers. The pump chambers sweep in succession across and transfer fluid from the inlet port to the discharge port and are sealed closed in the sealing land to prevent backflow. The housing has a stationary pre-charging passage which communicates with the discharge port and overlaps the sealing land. The rotating group includes a plurality of rotating pre-charging passages which communicate with respective ones of the pump chambers. As each rotating pre-charging passage attains overlap with the stationary pre-charging passage, the low pressure of the fluid trapped in the corresponding pump chamber sealed closed in the sealing land increases rapidly and induces a pulse in the fluid in the discharge port and in the fluid system connected to the discharge port. The angular separation between the rotating pre-charging passages is randomly unequal so that the intervals between the corresponding pulses is irregular. The irregularity of the intervals between the pulses suppresses tonal pump noise.

DESCRIPTION OF PRIOR ART

Figure 1:
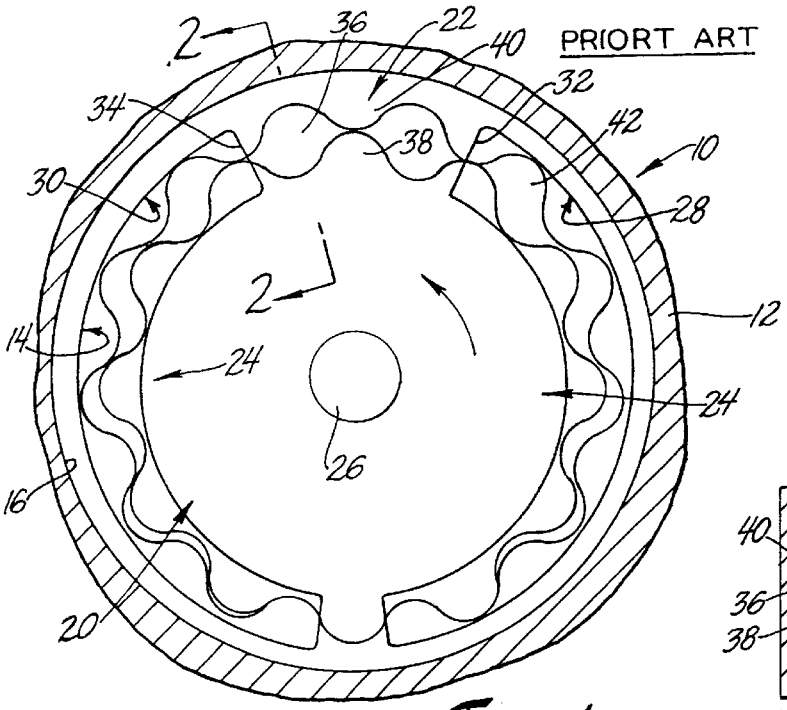
FIG. 1 is a schematic plan view of a typical prior art gerotor type positive displacement rotary pump.
Figure 2:
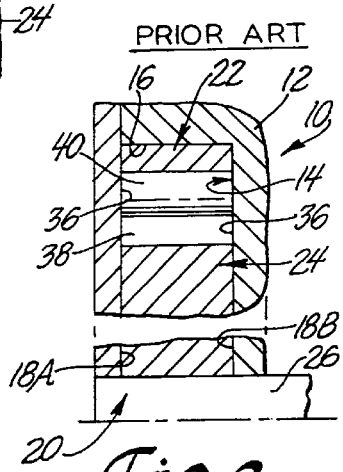
FIG. 2 is a sectional view taken generally along the plane indicated by lines 2—2 in FIG. 1.

Referring to FIGS. 1–2, a typical gerotor type positive displacement rotary pump 10 includes a stationary housing 12 having an internal chamber 14 therein. The internal chamber includes a cylindrical outer wall 16 and a pair of flat end walls 18A,18B. A rotating group 20 of the rotary pump is disposed in the internal chamber 14 and includes of an outer ring 22 and an inner ring 24. The outer wall 16 journals the outer ring 22 in the internal chamber for rotation about an axis at the geometric center of the outer wall. The inner ring 24 is supported in the internal chamber in the outer ring 22 by a schematically represented drive shaft 26 for counterclockwise rotation, FIG. 1, about a second axis parallel to and separated from the first axis.

The internal chamber 14 is intersected by an arc-shaped inlet port 28 and by an arc-shaped discharge port 30 in the end wall 18A. In the counterclockwise direction of rotation of the inner ring 24, the inlet port 28 has a downstream end 32 and the discharge port 30 has an upstream end 34. The end walls 18A, 18B cooperate in defining on the housing a sealing land 36 between the downstream and upstream ends 32,34, respectively, of the inlet and discharge ports. The inner ring 24 has a plurality of "N" outward facing lobes 38. The outer ring 22 has a plurality of (N+1) inward facing lobes 40. The outward facing lobes 38 mesh with the inward facing lobes 40 opposite the sealing land 36 to prevent backflow from the discharge port to the inlet port and to induce counterclockwise rotation of the outer ring concurrent with counterclockwise rotation of the inner ring. The outward and inward facing lobes 38,40 further cooperate in defining therebetween a plurality of pump chambers 42 which sweep in succession at regular intervals across the inlet port 28, the sealing land 36, and the discharge port 30 during rotation of the rotating group.

The inlet port 28 is connected to a source of fluid, not shown, at atmospheric pressure. The discharge port 30 is connected to a fluid system, not shown, having a pressure regulator therein. Each pump chamber 42 fills with fluid as it traverses the inlet port, traverses the sealing land, and expels fluid as it traverses the discharge port. The pump chambers entirely within the sealing land 36 are sealed closed relative to each other and to the inlet and discharge ports at respective ones of a plurality of tangential interfaces between the inward and outward facing lobes. The pump chambers thus transfer fluid from the inlet to the discharge port to develop a high regulated fluid pressure in the discharge port and in the fluid system connected thereto.

The pressure of the fluid trapped in the pump chambers sealed closed in the sealing land 36 is typically well below high fluid pressure prevailing in the discharge port and in the fluid system connected to the discharge port. Thus, as each pump chamber sealed closed in the sealing land attains overlap with the upstream end 34 of the discharge port, the fluid pressure therein increases substantially instantly to the high fluid pressure prevailing in the discharge port. Such rapid increase in fluid pressure induces a pulse in the fluid in the discharge port and in the fluid system connected thereto. Since the pump chambers 42 sweep in succession at regular intervals across the sealing land, the aforesaid pulses repeat at regular intervals and constitute a potential source of annoying pump noise having tonal character, i.e. noise that is concentrated at a discrete frequency and possibly whole number multiples of that frequency called harmonics.

DESCRIPTION OF THE PREFERRED EMBODIMENTS

Figure 3:
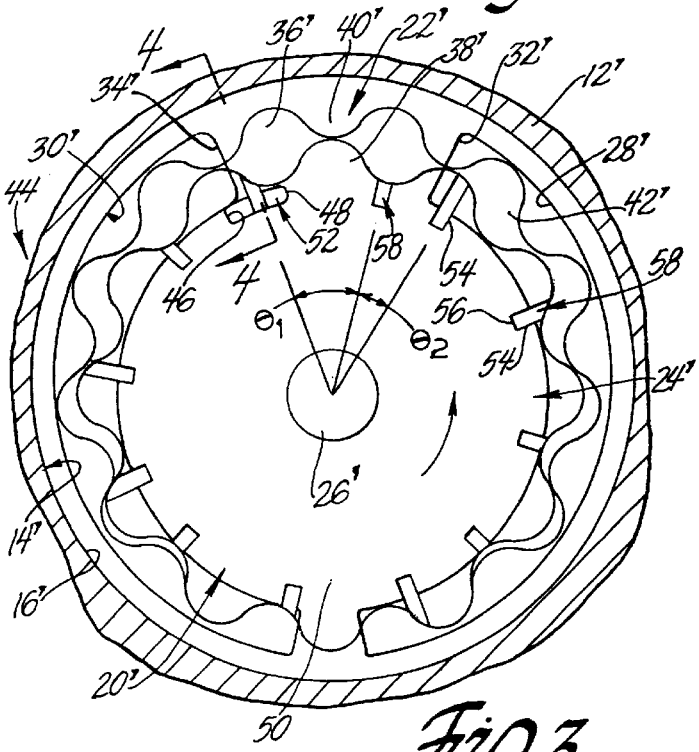
FIG. 3 is a schematic plan view of a positive displacement rotary pump according to this invention in a gerotor pump application.
Figure 4:
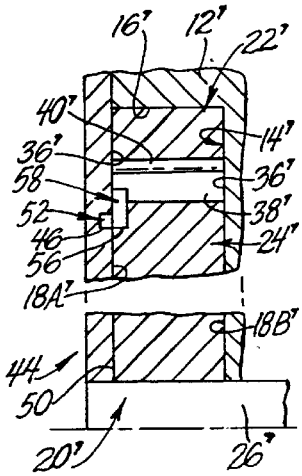
FIG. 4 is a sectional view taken generally along the plane indicated by lines 4—4 in FIG. 3.

Referring to FIGS. 3–4, a schematically represented gerotor type positive displacement rotary pump 44 according to this invention includes a plurality of structural elements substantially identical to the prior art gerotor pump 10 described above and identified in FIGS. 3–4 with primed reference characters. In addition to the structural elements described above, the rotary pump 44 according to this invention further includes a groove 46 in the end wall 18A' of the internal chamber which intersects and communicates with the discharge port 30' and terminates at a closed end 48 within the angular interval of the sealing land 36'. The groove 46 cooperates with a side 50 of the inner ring 24' in defining a stationary pre-charging passage 52 on the housing 12' which overlaps the discharge port and the sealing land. The stationary pre-charging passage is located radially inboard of the root circle of the outward facing lobes 38' on the inner ring so that the stationary pre-charging passage is isolated from the pump chambers 42' in the sealing land 36'.

The side 50 of the inner ring 24' is interrupted by a plurality of radial grooves 54 each of which intersects a respective one of the pump chambers 42' and terminates at a closed end 56 inboard of the root circle of the outward facing lobes 38'. The radial grooves 54 cooperate with the end wall 18A' of the internal chamber in defining a plurality of rotating pre-charging passages 58. Importantly, the rotating pre-charging passages are separated from each other around the inner ring 24' in random fashion represented schematically by respective ones of a pair of unequal separation angles $\theta_1$, $\theta_2$.

The stationary and rotating pre-charging passages 52,58 cooperate to connect the discharge port to succeeding ones of the pump chambers while the latter are still sealed closed in the sealing land and at irregular intervals. That is, as each pump chamber 42' traverses the sealing land 36' the fluid pressure therein remains low until the corresponding one of the rotating pre-charging passages 58 attains overlap with the stationary pre-charging passage. This overlap occurs before the corresponding pump chamber overlaps the upstream end 34' of the discharge port and establishes communication between the pump chamber and the discharge port. At that instant, fluid pressure in the pump chamber increases rapidly to the high pressure in the discharge port and induces a pulse in the fluid in the discharge port and in the fluid system connected thereto.

The aforesaid rapid increase in fluid pressure in each succeeding pump chamber 42' induces a corresponding pulse in the fluid in the discharge port and the fluid system connected thereto. With the rotating group rotating at constant speed, the intervals between succeeding pulses is determined by the angular intervals between succeeding ones of the rotating pre-charging passages. Because these angular intervals are randomly unequal, the pulses occur at random intervals during each revolution of the rotating group. Accordingly, the source of tonal pump noise in the prior art rotary pump 10 attributable to such pulses occurring at regular intervals is significantly reduced or eliminated in the rotary pump 44 according to this invention. It will be apparent from the foregoing that tonal noise suppression may be effected by fewer rotating pre-charging passages 58 on the rotating group than the number of pump chambers defined by the rotating group. It will be further apparent that the stationary pre-charging passage could be replaced functionally by an extension of each rotating pre-charging passage reaching ahead of the corresponding pump chamber in the direction of rotation of the rotating group.

Figure 5:
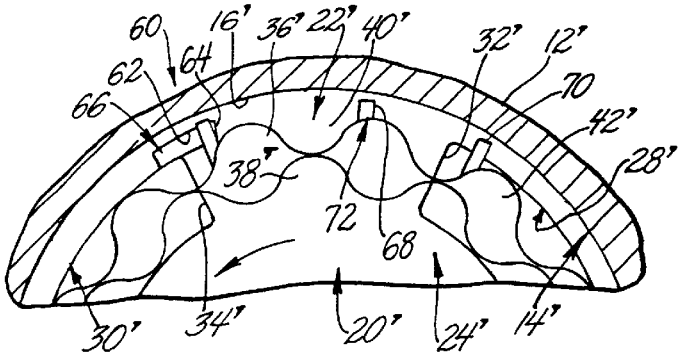
FIG. 5 is a fragmentary schematic plan view of a modified positive displacement rotary pump according to this invention in a gerotor pump application.

A modified gerotor type positive displacement rotary pump 60 according to this invention is fragmentarily illustrated FIG. 5 and is identical to the rotary pump 44 according to this invention described above except for the locations of the stationary and rotating pre-charging passages. Specifically, the modified rotary pump 60 includes a groove 62 in the end wall 18A' of the internal chamber which intersects and communicates with the discharge port 30' and terminates at a closed end 64 within the angular interval of the sealing land 36'. The groove 62 cooperates with a facing side of the outer ring 22' in defining a stationary pre-charging passage 66 on the housing 12' which overlaps the discharge port and the sealing land radially outboard of the root circle of the inward facing lobes 40'.

The aforesaid facing side of the outer ring 22' is interrupted by a plurality of radial grooves 68 each of which intersects a respective one of the pump chambers 42' and terminates at a closed end 70 outboard of the root circle of the inward facing lobes 40'. The radial grooves 68 cooperate with the end wall 18A' of the internal chamber in defining a plurality of rotating pre-charging passages 72 separated angularly from each other around the outer ring in random fashion. The stationary and rotating pre-charging passages 66,72 cooperate as described above to suppress tonal pump noise by disrupting the regularity of the pulses in the fluid in the discharge port and in the fluid system connected thereto attributable to rapidly increasing pressure in succeeding ones of the pump chambers 42' in the sealing land 36'.

Figure 6:
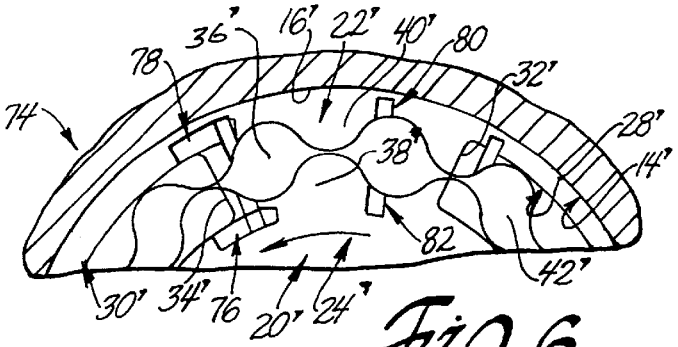
FIG. 6 is a fragmentary schematic plan view of a second modified positive displacement rotary pump according to this invention in a gerotor pump application.

A second modified gerotor type positive displacement rotary pump 74 according to this invention is fragmentarily illustrated FIG. 6 and combines structural features of the rotary pumps 44,60 according to this invention described above. That is, the rotary pump 74 includes an inner stationary pre-charging passage 76 and an outer stationary pre-charging passage 78 each of which communicates with the discharge port 30' of the pump and overlaps the sealing land 36' between the discharge port and the inlet port 28'. The outer ring 22' includes a plurality of randomly angularly separated outer rotating pre-charging passages 80 intersecting respective ones of the pump chambers 42'. The inner ring 24' includes a plurality of randomly angularly separated inner rotating pre-charging passages 82 likewise intersecting respective ones of the pump chambers 42'.

The fluid pressure succeeding ones of pump chambers 42' in the sealing land 36' increases to the fluid pressure prevailing in the discharge port when the first one of the inner and outer rotating pre-charging passages 82,80 connected thereto overlaps the corresponding one at the inner and outer stationary pre-charging passages 76,78. As described above, the corresponding pulses in the fluid in the discharge port and in the fluid system connected thereto occur at irregular intervals because of the random angular separation between the rotating pre-charging passages. In addition, the pairs of inner and outer rotating pre-charging passages 82,80 connected to each of the pump chambers changes in succeeding revolutions the rotating group because the outer ring 22' rotates relative the inner ring 24' as a result of the difference between the number of inward and outward facing lobes 40',38' on the rings. The pulse randomization afforded by the stationary and rotating pre-charging passages is thus extended beyond each revolution of the rotating group of the second modified rotary pump 74.

Figure 7:
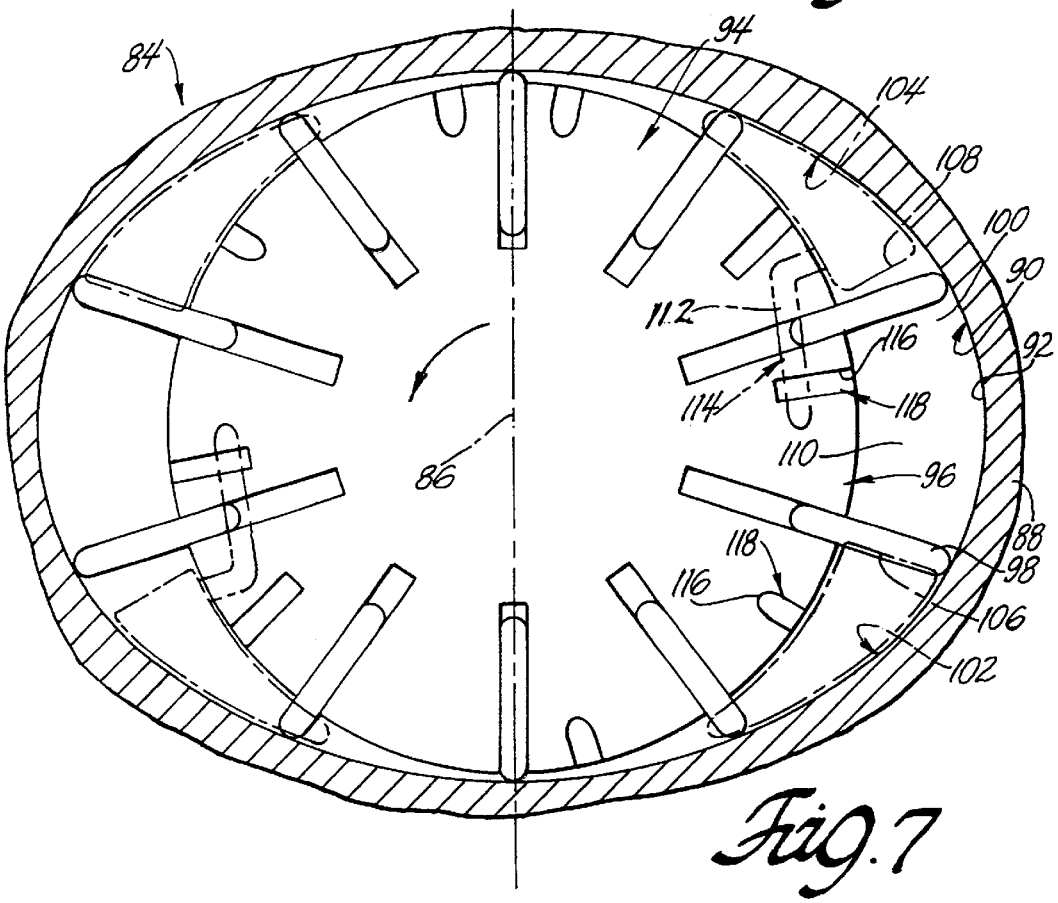
FIG. 7 is a schematic plan view of a positive displacement rotary pump according to this invention in a vane pump application.

A positive displacement rotary pump 84 according to this invention in a vane pump application is schematically illustrated in FIG. 7. Because the pump 84 is symmetric on opposite sides of a center plane 86, description of only one side of the pump is provided below and required for adequate understanding of the structure and operation of the pump. The rotary pump 84 includes a stationary housing 88 having a internal chamber 90 therein defined by an oval-shaped outer wall 92 and a pair of opposite end walls, not shown, closing the internal chamber. A rotating group 94 is disposed in the internal chamber 90 and includes a rotor 96 supported on the housing for counterclockwise rotation about an axis at the geometric center of the internal chamber. A plurality of vanes 98 are supported on the rotor for radial reciprocation in a corresponding plurality of slots equally angularly spaced around the rotor. The vanes 98 bear against the oval-shaped outer wall 92 and define therebetween a plurality of pump chambers 100 which rotate counterclockwise with the rotor.

One of the end walls of the internal chamber 90 is intersected by an arc-shaped inlet port 102 and by an arc-shaped discharge port 104. In the direction of rotation of the rotor 96, the inlet port 102 has a downstream end 106 and the discharge port 104 has an upstream end 108 separated from the downstream end of the inlet port by a sealing land 110 on the housing. The inlet port 102 is connected to a source of fluid, not shown, at atmospheric pressure. The discharge port 104 is connected to a fluid system, not shown, having a pressure regulator therein. Each pump chamber 100 fills with fluid as it traverses the inlet port, traverses the sealing land, and expels fluid as it traverses the discharge port. The pump chambers entirely within the sealing land 110 are sealed closed relative to each other and to the inlet and discharge ports. The pump chambers thus transfer fluid from the inlet port to the discharge port to develop a high regulated fluid pressure in the discharge port and in the fluid system connected thereto.

The rotary pump 84 further includes a schematically represented groove 112 in the end wall of the internal chamber 90 which intersects and communicates with the discharge port and terminates at a closed end within the angular interval of the sealing land 110. The groove 112 cooperates with the facing side of the rotor 96 in defining a stationary pre-charging passage 114 on the housing 88 which overlaps the discharge port and the sealing land radially inboard of the outside diameter of the rotor. The rotor 96 includes a plurality of randomly angularly separated grooves 116 in the side thereof facing the stationary pre-charging passage. Each groove 116 intersects a corresponding one of the pump chambers 100 and terminates at a closed end. The grooves 116 cooperate with the facing end wall of the internal chamber in defining a plurality of rotating pre-charging passages 118 which rotate with the rotating group.

The stationary and rotating pre-charging passages 114,118 cooperate to connect the discharge port 104 to succeeding ones of the pump chambers 100 while the latter are still sealed closed in the sealing land 110 and at irregular intervals. That is, as each pump chamber 100 traverses the sealing land 110 the fluid pressure therein remains low until the corresponding one of the rotating pre-charging passages 118 attains overlap with the stationary pre-charging passage. This overlap occurs before the corresponding pump chamber overlaps the upstream end 108 of the discharge port and establishes communication between the pump chamber and the discharge port. At that instant, the fluid pressure in the pump chamber increases rapidly to the high pressure in the discharge port and induces a pulse in the fluid in the discharge port and the fluid system connected thereto.

The aforesaid rapid increase in fluid pressure in each succeeding pump chamber 100 induces a corresponding pulse in the fluid in the discharge port and the fluid system connected thereto. With the rotating group rotating at constant speed, the intervals between succeeding pulses is determined by the angular intervals between succeeding ones of the rotating pre-charging passages 118. Because these angular intervals are randomly unequal, the pulses occur at random intervals during each revolution of the rotating group. Accordingly, the source of tonal pump noise in the prior art rotary pump 10 attributable to such pulses occurring at regular intervals is significantly reduced or eliminated in the rotary pump 84 according to this invention. It will be apparent from the foregoing that tonal noise suppression may be effected by fewer rotating pre-charging passages 118 on the rotating group than the number of pump chambers defined by the rotating group. It will be further apparent that the stationary pre-charging passage could be replaced functionally by an extension of each rotating pre-charging passage reaching ahead of the corresponding pump chamber in the direction of rotation of the rotating group.

While only preferred embodiments of this invention have been described herein, it will be appreciated that other forms could be readily adapted by one skilled in the art. Accordingly, the scope of this invention is to be considered limited only by the following claims.

The embodiments of the invention in which an exclusive property or privilege is claimed are defined as follows:

1. A positive displacement rotary pump comprising:

a housing having an internal chamber, an inlet port in the housing intersecting the internal chamber having a downstream end and connected to a source of fluid at low pressure, a discharge port in the housing intersecting the internal chamber having an upstream end and connected to a fluid system, a sealing land on the housing separating the downstream end of the inlet port from the upstream end of the discharge port, a rotating group in the internal chamber defining a plurality of pump chambers which during rotation of the rotating group and at regular intervals traverse in succession the inlet port and the sealing land and the discharge port and which are sealed closed in the sealing land during traverse thereof so that a high fluid pressure develops in the discharge port and in the fluid system, a pre-charging passage means operable to establish fluid communication between the discharge port and a selected one of the plurality of pump chambers while the selected one of the plurality of pump chambers is sealed closed in the sealing land thereby to increase the fluid pressure in the selected one of the plurality of pump chambers to the high fluid pressure prevailing in the discharge port before the selected one of the plurality of pump chambers overlaps the upstream end of the discharge port, wherein the pre-charging passage means comprises:

a stationary pre-charging passage on the housing communicating with the discharge port and terminating at a closed end in the angular interval defined by the sealing land remote from the ones of the pump chambers sealed closed in the sealing land, and a rotating pre-charging passage on the rotating group communicating with the selected one of the plurality of pump chambers and terminating at a closed end and overlapping the stationary pre-charging passage while the selected one of the plurality of pump chambers is sealed closed in the sealing land.

2. The positive displacement rotary pump recited in claim 1 further comprising:

a plurality of additional rotating pre-charging passages on the rotating group communicating with respective individual ones of the plurality of pump chambers and spaced apart by unequal angles of separation, each of the plurality of additional rotating pre-charging passages overlapping the stationary pre-charging passage while the corresponding one of the plurality of pump chambers is sealed closed in the sealing land thereby to increase the fluid pressure in the corresponding one of the plurality of pump chambers to the high fluid pressure prevailing in the discharge port before the corresponding one of the plurality of pump chambers overlaps the upstream end of the discharge port.

3. The positive displacement rotary pump recited in claim 1 wherein the rotating group comprises:

an inner ring having a plurality of N outward facing lobes and supported on the housing for rotation about a first axis, and an outer ring around the inner ring having a plurality of N+1 inward facing lobes and supported on the housing for rotation about a second axis parallel to and separated from the first axis, the outward facing lobes meshing with the inward facing lobes opposite the sealing land to separate the inlet port from the discharge port and to induce rotation of the outer ring concurrent with rotation of the inner ring, and the inward facing lobes cooperating with the outward facing lobes in defining a plurality of pump chambers which during rotation of the inner ring and the outer ring and at regular intervals traverse in succession the inlet port and the sealing land and the discharge port and which are sealed closed in the sealing land during traverse thereof so that a high fluid pressure develops in the discharge port and in the fluid system.

4. The positive displacement rotary pump recited in claim 3 wherein the rotating pre-charging passage is on one of the inner ring and the outer ring.

5. The positive displacement rotary pump recited in claim 4 further comprising:

a plurality of additional rotating pre-charging passages on one of the inner ring and the outer ring communicating with respective individual ones of the plurality of pump chambers and spaced apart around the inner ring by unequal angles of separation, each of the plurality of additional rotating pre-charging passages overlapping the stationary pre-charging passage while the corresponding one of the plurality of pump chambers is sealed closed in the sealing land thereby to increase the fluid pressure in the corresponding one of the plurality of pump chambers to the high fluid pressure prevailing in the discharge port before the corresponding one of the plurality of pump chambers overlaps the upstream end of the discharge port.

6. The positive displacement rotary pump recited in claim 3 wherein the stationary and rotating pre-charging passages, respectively, further comprise:

an inner stationary pre-charging passage on the housing communicating with the discharge port and terminating at a closed end in the angular interval defined by the sealing land radially inboard of and remote from the ones of the pump chambers sealed closed in the sealing land, an outer stationary pre-charging passage on the housing communicating with the discharge port and terminating at a closed end in the angular interval defined by the sealing land radially outboard of and remote from the ones of the pump chambers sealed closed in the sealing land, a plurality of inner rotating pre-charging passages on the inner ring communicating individually with corresponding ones of the plurality of pump chambers and terminating at closed ends radially inboard of the corresponding ones of the plurality of pump chambers, and a plurality of outer rotating pre-charging passages on the outer ring communicating individually with the corresponding ones of the plurality of pump chambers and terminating at closed ends radially outboard of the corresponding ones of the plurality of pump chambers so that each one of the plurality of pump chambers has a pair of the inner and outer rotating pre-charging passage connected thereto, one of the inner and outer rotating pre-charging passages in each pair overlapping the corresponding one of the inner and the outer stationary pre-charging passages while the corresponding one of the plurality of pump chambers is sealed closed in the sealing land thereby to increase the fluid pressure in the corresponding one of the plurality of pump chambers to the high fluid pressure prevailing in the discharge port before the corresponding one of the pump chambers overlaps the upstream end of the discharge port.

7. The positive displacement rotary pump recited in claim 1 wherein the rotating group comprises:

an oval-shaped wall around the internal chamber in the housing, a rotor having a plurality of equally angularly spaced radial slots therein supported on the housing in the internal chamber for rotation about an axis at the geometric center of the oval-shaped outer wall, and a plurality of vanes supported in respective ones of the radial slots in the rotor for radial reciprocation and bearing against the oval-shaped outer wall to define therebetween a plurality of pump chambers which during rotation of the rotor and at regular intervals traverse in succession the inlet port and the sealing land and the discharge port and which are sealed closed in the sealing land during traverse thereof so that a high fluid pressure develops in the discharge port and in the fluid system.

8. The positive displacement rotary pump recited in claim 7 further comprising:

a plurality of additional rotating pre-charging passages on the rotor communicating with respective individual ones of the plurality of pump chambers and spaced apart around the rotor by unequal angles of separation, each of the plurality of additional rotating pre-charging passages overlapping the stationary pre-charging passage while the corresponding one of the plurality of pump chambers is sealed closed in the sealing land thereby to increase the fluid pressure in the corresponding one of the plurality of pump chambers to the high fluid pressure prevailing in the discharge port before the corresponding one of the plurality of pump chambers overlaps the upstream end of the discharge port.

* * * * *